US005568232A

United States Patent [19]

Kashihara

[11] Patent Number: 5,568,232

[45] Date of Patent: Oct. 22, 1996

[54] IMAGE FORMING APPARATUS CAPABLE OF REMOVING TONER FRAGMENTS AND SHAVINGS FROM A CONTACT CHARGING DEVICE BY SUPPLYING A VOLTAGE TO AN IMAGE CARRIER TO WHICH THE FRAGMENTS AND SHAVINGS ARE ATTRACTED

[75] Inventor: Mabumi Kashihara, Tokyo, Japan

[73] Assignee: NEC Corporation, Tokyo, Japan

[21] Appl. No.: 407,085

[22] Filed: Mar. 20, 1995

[30] Foreign Application Priority Data

Mar. 18, 1994 [JP] Japan ..... 6-048204

[51] Int. Cl.[6] ..... G03G 15/02

[52] U.S. Cl. ..... 355/219; 355/268

[58] Field of Search ..... 355/219, 265, 355/268; 361/225

[56] References Cited

U.S. PATENT DOCUMENTS 5,371,578 12/1994 Asano et al. ..... 355/219

FOREIGN PATENT DOCUMENTS 6-258919 9/1994 Japan ..... 355/219

*Primary Examiner*—Joan H. Pendegrass
*Assistant Examiner*—Quana Grainger
*Attorney, Agent, or Firm*—Sughrue, Mion, Zinn, Macpeak & Seas

[57] ABSTRACT

An image forming apparatus including an electrostatic latent image carrier which has a first voltage of the same polarity as the charge characteristics of the electrostatic latent image carrier, a contact charging device which has a second voltage of the same polarity as the charge characteristics of the electrostatic latent image carrier and a lower absolute value than the first voltage, and a toner carrier which has a third voltage of the same polarity as the charge characteristics of the electrostatic latent image carrier and a lower absolute value than the first voltage. During the non-imaging period, the toner fragments and shavings on the charging device are attracted to the electrostatic latent image carrier due to the potential difference between the charging device and the electrostatic latent image carrier. Additionally, by applying the third voltage to the toner carrier, none of the toners are able to adhere onto the reduced potential region which is created by supplying the second voltage to the charging device.

13 Claims, 7 Drawing Sheets

| | TIME (msec) |
|---|---|
| T0 | 1000 |
| T1 | 944 |
| T2 | 2953 ~ 3558 |
| T3 | 1020 |
| T4 | 8980 |
| T5 | 1689 |
| T6 | 600 |
| T7 | 1766 |
| T8 | 10 |
| T9 | 1600 |
| TK | 270 |
| T11 | 484 |
| T12 | 364 |
| T13 | 360 |
FIG.9
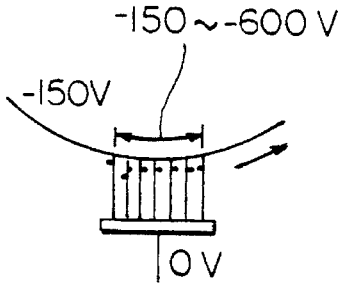
FIG.10
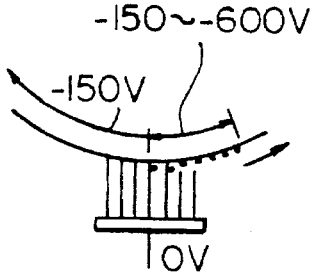
FIG.11
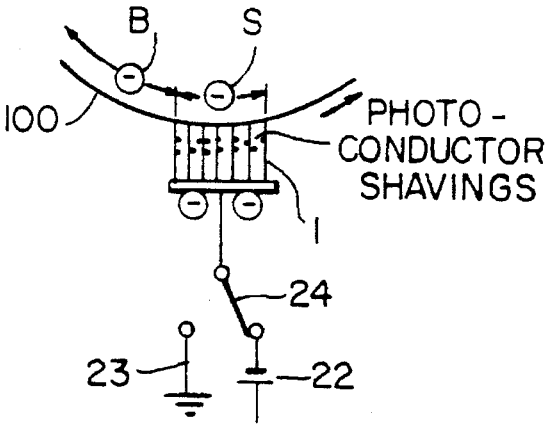
FIG.13

FIG. 14
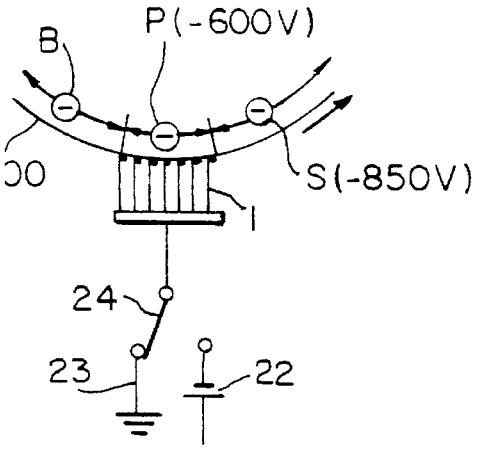
FIG. 16
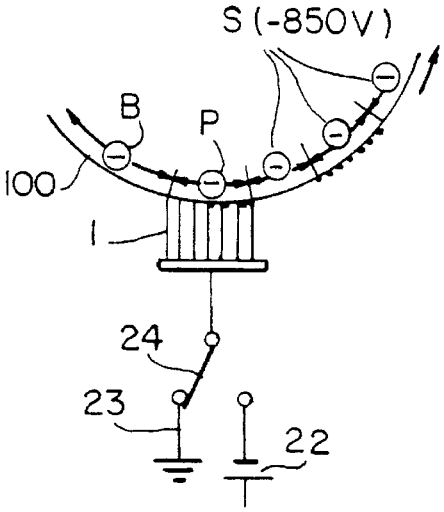
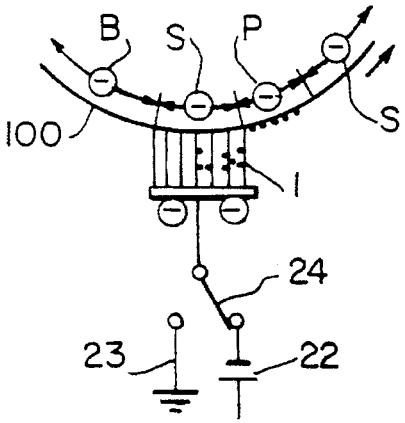
FIG. 15
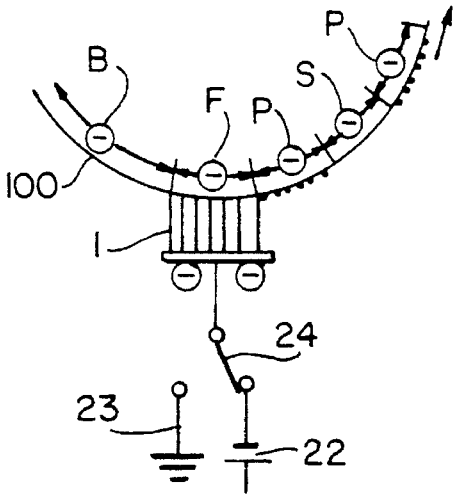
FIG. 17

IMAGE FORMING APPARATUS CAPABLE OF REMOVING TONER FRAGMENTS AND SHAVINGS FROM A CONTACT CHARGING DEVICE BY SUPPLYING A VOLTAGE TO AN IMAGE CARRIER TO WHICH THE FRAGMENTS AND SHAVINGS ARE ATTRACTED

BACKGROUND OF THE INVENTION

1. Field of the Invention

The present invention relates to an electrophotographic processing-based image forming apparatus for printers, facsimile machines, copying machines, etc., and particularly to the image forming apparatus using a contact charging device for charging an electrostatic latent image carrier.

2. Description of the Prior Art

A conventional electrophotographic image forming apparatus is equipped with a charging device for evenly charging the surface of the electrostatic latent image carrier such as a photoconductor drum. The charging device includes a corona discharging device, roller charging device, brush charging device, etc., of which the brush charging device is preferably used from the point of view of downsizing and avoiding generation of ozone.

The brush charging device is the contact charging device which is designed so that a brush of low-resistance bristles comes into contact with the surface of the electrostatic latent image carrier, and a high charging voltage is applied to the brush of bristles via a conductor. After charging the surface of the electrostatic latent image carrier, an electrostatic latent image is formed on the surface by a laser beam, and then, a toner image is formed by a developing device.

In the developing devices, however, there are generated fragments of the toner and/or shavings of the electrostatic latent image carrier which have been charged opposite to the toner charged with intended charge characteristics. Since the polarity of the toner fragments and the shavings is also opposite to the electrostatic latent image carrier, they adhere to the surface of the electrostatic latent image carrier during development. To make the matter worse, they cannot be satisfactorily removed by a cleaning device. As a result, the toner fragments and shavings which have failed to be cleaned off, adhere to the brush charging device and prevent normal charging.

A solution for overcoming this problem is presented in Japanese Patent Application Kohkai (Disclosure) HEI 4-371972 (a Japanese version of U.S. Pat. No. 5,371,578) issued on Dec. 24, 1992, which teaches applying a predetermined voltage having the same polarity as that of the electrostatic latent image carrier and a lower absolute value than the normal charging voltage to the brush charging device. The predetermined voltage is applied to the brush charging device during an inter-non-imaging period (the non-imaging period between formation of two successive images on the electrostatic latent image carrier). As shown in FIG. 1, the brush charging device 210 contacts with the surface of a photoconductor drum (or an electrostatic latent image carrier) 200. Assuming the charge characteristics of the photoconductor drum 200 are of negative polarity, a voltage of −1,100 volts is applied to the brush charging device 210 to charge the surface of the photoconductor drum 200 to −700 volts. Here, the fragments of the toner and the shavings with positive polarity which have failed to be removed by a cleaning device (not shown) are attracted to the brush charging device 210. During the subsequent inter-non-imaging period, the brush charging device 210 receives a temporary applied voltage of 0 volts (grounded), as shown in FIG. 2. The moment the brush charging device 210 reaches 0 volts, the toner fragments and shavings with positive polarity are attracted to the photoconductor drum 200 from the brush charging device. The result is adhesion of the toner fragments and shavings to the photoconductor drum 200 (in region (B) in FIG. 3), as shown in FIG. 3. In FIG. 3, region (A) is the region in which the brush charging device 210 has received the applied 0 volts.

The image forming apparatus described above, however, has the following drawbacks. Usually the photoconductor drum 200 is subjected to surface destaticization by a destaticizer prior to charging, and a 0-volt region is brought into contact with the brush charging device 210, as shown in FIG. 1. Usually, the 0-volt region of the photoconductor drum 200 cannot be charged to −700 (V) rapidly. This provides a charged region 200A extending between the two ends E and S in FIG. 1, with a voltage distribution shown in FIG. 4, wherein the voltage is 0 volts near the position E. Accordingly, as shown in FIG. 2, upon application of 0 volts to the brush charging device 210, the brush charging device 210 and the surface of the photoconductor drum 200 have little potential difference near the position E. Therefore, it is difficult to remove the toner fragments and shavings attached to a region near the position E. This drawback becomes more serious in cases where the brush charging device 210 in the state shown in FIG. 2 receives an additional voltage other than 0 volts (a voltage with the same charging characteristics as the photoconductor drum and having a lower absolute value than its charged voltage).

In addition, as shown in FIG. 3, the backward region (C) of the region (A) of the photoconductor drum 200, being at a voltage of 0 volts, attracts the toner when developed, and produces unwanted black set-solids. In order to prevent this production, the aforementioned prior art is designed to apply a bias voltage with positive polarity (+250 volts) to the developing device while the region (C) is in contact with the developing device. Accordingly, the bias supply for the developing device is required to generate both positively and negatively polarized voltages, and thus it becomes essential to have two separate transformers.

SUMMARY OF THE INVENTION

It is an object of the present invention to provide an image forming apparatus which allows complete removal of toner fragments and shavings with polarity opposite to the charged polarity of its electrostatic latent image carrier.

It is another object of the present invention to provide an image forming apparatus which does not need power supplies with different polarities.

The image forming apparatus according to the present invention comprises a circuit which provides an electrostatic latent image carrier with a first voltage, a circuit which provides the charging device with a second voltage, and a circuit which provides the toner carrier with a third voltage. The first voltage applied to the electrostatic latent image carrier has the same polarity as the charge characteristics of the electrostatic latent image carrier and toner, and has a lower absolute value than the charging voltage for charging the electrostatic latent image carrier. The second voltage has the same polarity as the charge characteristics of the electrostatic latent image carrier and has a lower absolute value than the first voltage. The second voltage is applied to the charging device during a non-imaging period during which neither formation nor development of an electrostatic latent image is performed. The third voltage has the same polarity as the charge characteristics of the electrostatic latent image carrier and has a lower absolute value than the first voltage. The third voltage is applied to the toner carrier during the non-imaging period.

The electrostatic latent image carrier maintains the same voltage as the first voltage. In addition, since the second voltage supplied to the charging device during the non-imaging period has the same polarity as and a lower absolute value than the first voltage, the toner fragments and shavings adhering to the charging device are attracted to the electrostatic latent image carrier due to the potential difference of the first voltage and the second voltage. This allows complete removal of the toner fragments and shavings which have adhered to the brush around the position E as shown in FIG. 1 and FIG. 2. A reduced-potential region is created by the supply of the second voltage to the charging device, however, since a third voltage which has the same polarity as and a lower absolute value than the first voltage is applied to the toner carrier at the developing station, no toner adheres to the reduced-potential region, and therefore not only are no unwanted black streaks recorded, but the polarity of the power supply for the developing station equals to the polarity of the charged toner. The power supply may thus be simplified.

BRIEF DESCRIPTION OF THE DRAWINGS

Other objects, features and advantages of the present invention will become more apparent when the following description is read in conjunction with the accompanying drawings, wherein:

FIG. 9 is a table of values of the respective time symbols in the timing chart of FIG. 8;

FIG. 10 is a diagram which shows the state of the first embodiment of the present invention when a voltage of 0 volts is applied to the charging device during a non-imaging period;

FIG. 11 is a diagram which shows the state of the first embodiment of the present invention, at a time shortly after the state shown in FIG. 10;

FIG. 13 through FIG. 17 are diagrams which show the charging operation of the second embodiment of the present invention during a non-imaging period.

DETAILED DESCRIPTION OF THE PREFERRED EMBODIMENTS

Figure 1:
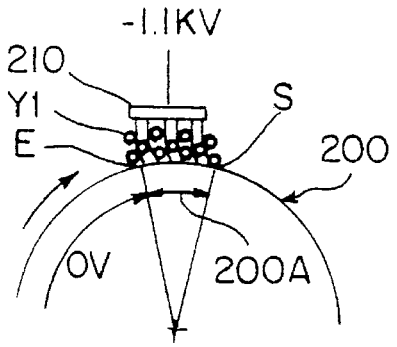
FIG. 1 PRIOR ART
FIG. 1 is a diagram showing how a photoconductor drum of a conventional image forming apparatus is charged during an imaging period.
Figure 2:
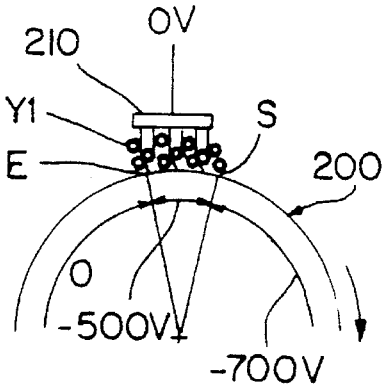
FIG. 2 PRIOR ART
FIG. 2 is a diagram showing the state of a conventional image forming apparatus when a voltage of 0 volts is applied to the charging device during a non-imaging period.
Figure 3:
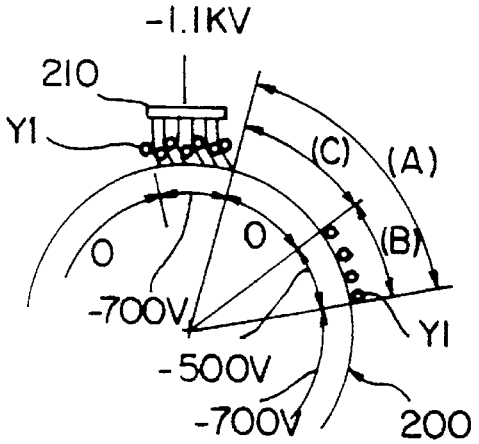
FIG. 3 PRIOR ART
FIG. 3 is a diagram showing the state of FIG. 2, but at a later time.
Figure 4:
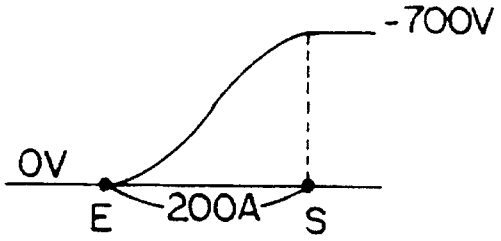
FIG. 4 PRIOR ART
FIG. 4 is a diagram showing the voltage distribution for the region 200A in FIG. 1.
Figure 5:
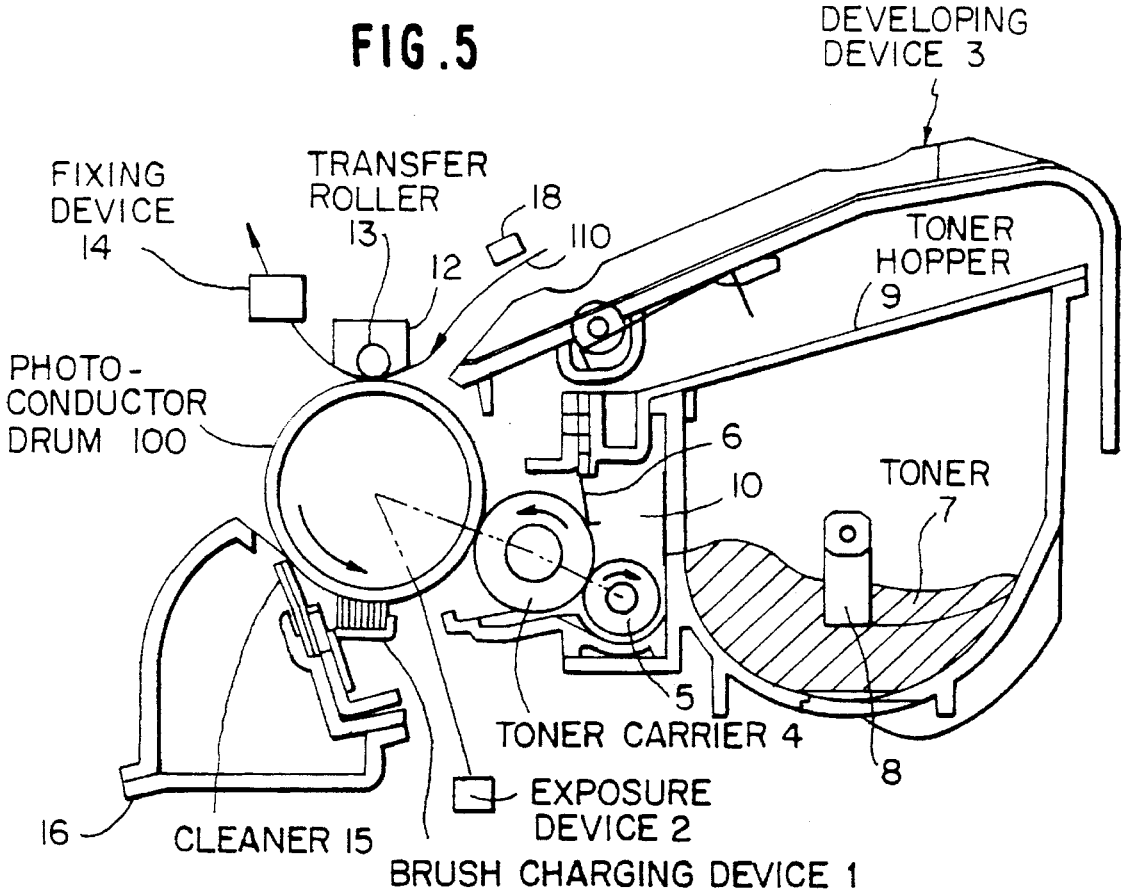
FIG. 5 is a cross sectional view of electrophotographic recording equipment to which an embodiment of the present invention is applied.

In FIG. 5, the electrophotographic recording device to which an embodiment of the present invention is applied comprises a photoconductor drum 100, or an electrophotographic latent image carrier; a brush charging device 1 which is in contact with the surface of the photoconductor drum 100; an exposure device 2; a developing device 3 for supplying toner to the surface of the photoconductor drum 100; a transfer device 12; a fixing device 14; and a cleaning device 15. The photoconductor drum 100 is composed of an aluminum drum substrate with a photoconductive film coated on its surface and has negative charge characteristics. The photoconductor drum 100 receives application of a photoconductor bias voltage (first voltage) with the same polarity as the charge characteristics thereof. This first voltage plays an important role for accomplishing the objects of the present invention. The absolute value of the first voltage is much smaller than that of the charging voltage, and is preferably on the order of −50 to −200 volts. The first voltage in the case of FIG. 5 is −150 volts.

The brush charging device 1 receives a charging voltage of −1100 volts when the photoconductor drum 100 is charged. This charging voltage charges the photoconductor drum 100 evenly to −700 volts, but the surface of the photoconductor drum 100 becomes substantially charged to −850 volts upon addition of the photoconductor bias voltage. After being charged, the surface of the photoconductor drum 100 receives laser light irradiated from the exposure device 2. The light source of the exposure device 2 may be a laser, LED, etc., which emits light in response to the pictorial data. Upon irradiating the photoconductor drum 100 with laser light, the charged voltage of the charged portion is lowered to form a electrostatic latent image.

The developing device 3 comprises a toner feeding chamber 10 equipped with a toner carrier 4 and a feeding roller 5, and a toner hopper 9 for storing toner 7. The toner 7, or developer, has negative charge characteristics. The toner 7 is stirred by a stirring member 8. This stirring directs the toner to the feeder roller 5 formed of a material such as conductive or insulating urethane or silicon or a urethane or silicone foam, and then to the roller-like toner carrier 4 in contact with the feeder roller 5. The toner carrier 4 is formed of a flexible material such as silicone rubber, urethane rubber, nitrile-butylene rubber, natural rubber, an urethane or silicon foam, or a surface-treated product thereof.

The amount of toner fed to the toner carrier 4 is controlled by a control blade 6 constructed of a metal spring member made of, e.g., stainless steel, phosphor bronze or nickel silver, to form an even toner film of substantially one layer. At this point in time, the toner 7 becomes negatively charged by friction. The control blade 6 is anchored on a toner hopper 9, with its front end in contact with the surface of the toner carrier 4. When opposed to the photoconductor drum 100, the toner carrier 4, to which is applied a developing bias voltage with the same polarity (negative voltage) as the charge characteristics of the photoconductor 100, adheres to the surface of the photoconductor drum 100 which has been positively charged by exposure, and thus the development is accomplished to form a toner image. Here it is to be noted that throughout the specification the "positively charged"

signifies not only "charged to a positive potential", but in a wide sense "processed to lose charge to decrease the absolute value of the negative potential".

The toner image on the photoconductor drum 100 is transferred onto a recording medium 110 such as a plain paper by a transfer device 12, and the transferred toner image is fixed on the recording medium 110 at a fixing device 14. At the transfer station 12 the toner image is transferred to the recording medium 110 by a transfer roller 13. When the surface potential of the transfer roller 13 is changed to a positive value, the toner image at a negative potential on the photoconductor drum is attracted to the transfer roller 13 end, and more specifically to the recording medium 110, and transferred thereon. During non-transfer periods the transfer roller 13 is maintained at the same potential as the photoconductor drum 100. After transfer is completed, the toner remaining on the photoconductor drum 100 is removed by a cleaner 15. The cleaner 15 is anchored by a cleaner body 16 which collects the removed toner.

Figure 6:
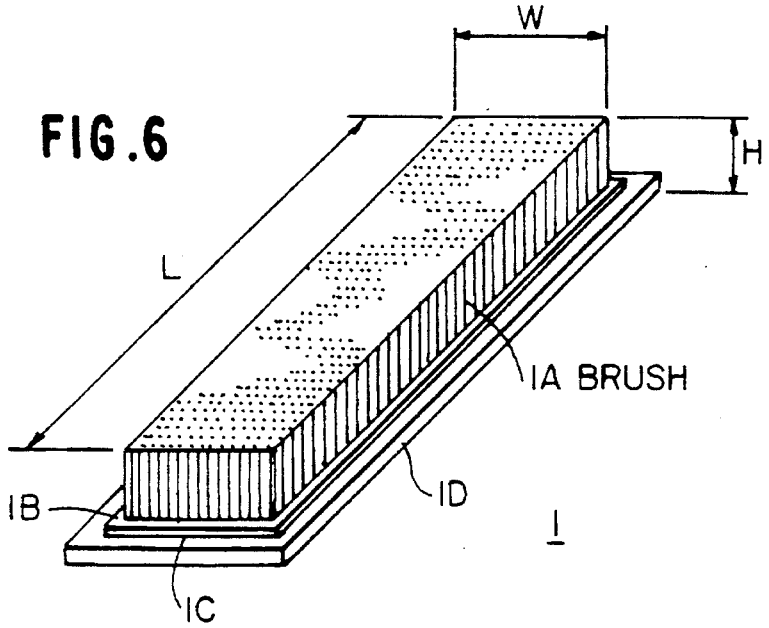
FIG. 6 is a perspective view of a brush charging device used in the electrophotographic recording equipment of FIG. 5.

In FIG. 6, a brush charging device 1 comprises a brush 1A, a base cloth 1B and a conductive board 1D. The brush 1A is an arrangement of bundles each consisting of ninety-six acrylic filament fibers with an electric resistance of about $1\times10^4\Omega\cdot$cm and a fineness of 6.2 deniers, with a density of 100,000 filaments/inch$^2$. The base cloth 1B is fixed to the conductive board 1D by means of a conductive double-coated tape 1C. The brush 1A runs through the base cloth 1B to the conductive double-coated tape 1C. The brush 1A is sized to a length L=220 mm, a width W=6 mm and a height H=5 mm. Here, the height H of the brush 1A is measured to include the base cloth 1B and the conductive double-coated tape 1C. The fiber to be used for the construction of the brush is only required to have a resistance value of $10^3$–$10^5\Omega\cdot$cm, and may be, for example, a synthetic fiber such as propylene, rayon, nylon, polyester, polycarbonate, polyvinyl alcohol fiber or the like. Further, illustrative examples of the material for the conductive board 1D are stainless steel, iron, copper, aluminum and other metals and semiconductive engineering plastics.

Figure 7:
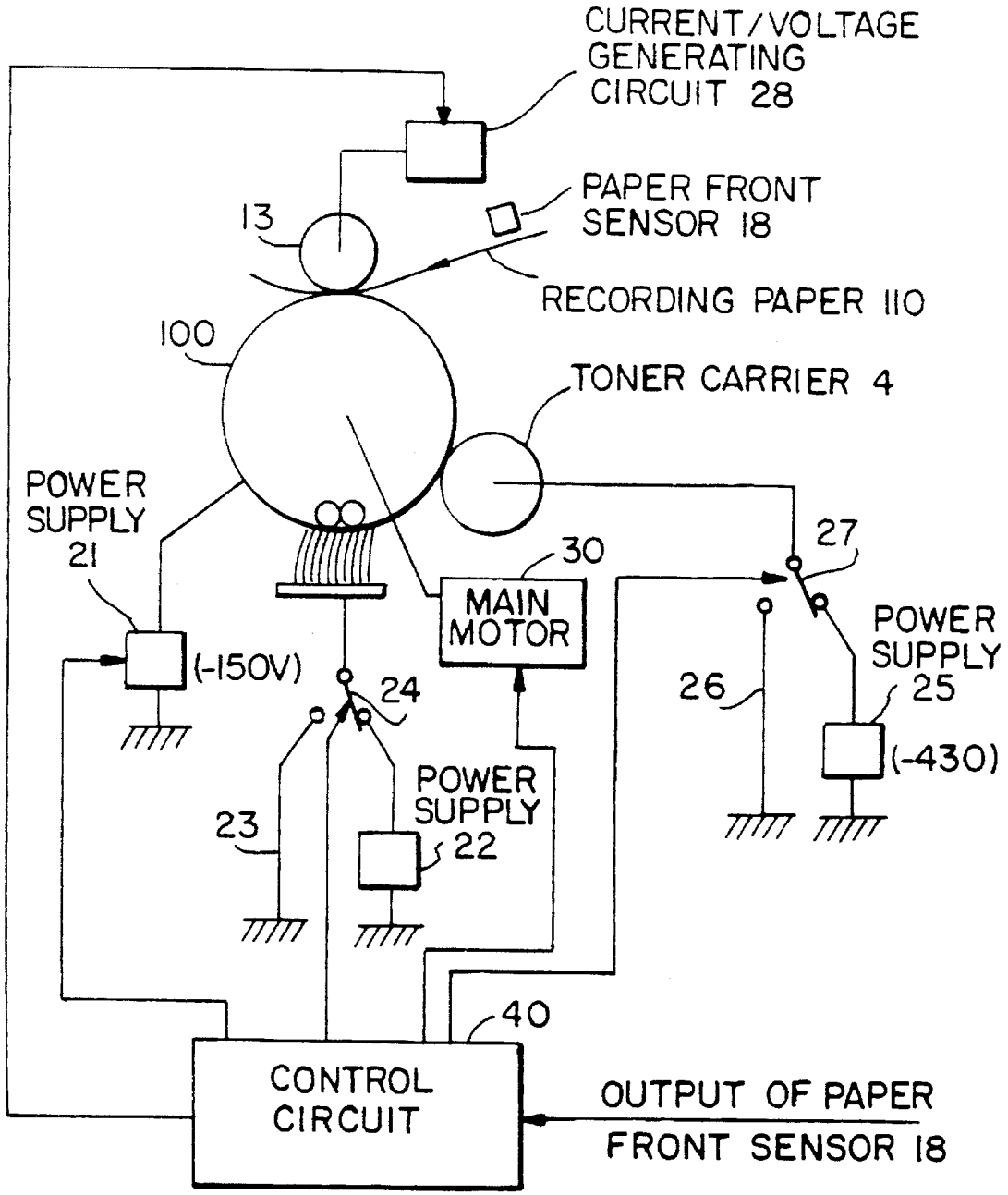
FIG. 7 is a diagram which shows an image forming apparatus which is a first embodiment of the present invention.

FIG. 7 is a circuitry diagram of an image forming apparatus as a first embodiment of the present invention, for the electrophotographic recording equipment shown in FIG. 5. In the drawing, the photoconductor drum 100 is rotated by a main motor 30. A power supply circuit 21, being connected to the aluminum substrate of the photoconductor drum 100, supplies a first voltage of −150 volts thereto. The brush charging device 1 is connected to either a grounding line 23 or a power supply circuit 22 via a switch 24. The grounding line 23 generates a second voltage of 0 volts, while the power supply circuit 22 generates a charging voltage of −1,100 volts. The charging voltage is not required to be a DC voltage, and may be a superimposition of AC and DC voltages. The toner carrier 4, which supplies toner to the photoconductor drum 100, connects to either a grounding line or a power supply circuit 25 via a switch 27. The grounding line 26 generates a third voltage of 0 volts, while the power supply circuit 25 generates a developing bias voltage of −430 volts. In the process of charging and developing, the switches 24 and 27 are connected to the power supply circuits 22 and 26, respectively. A current/voltage generating circuit 28 supplies a transfer current/voltage to a transfer roller 13. When a recording medium 110 is moved to between the transfer roller 13 and the photoconductor drum 100 for transfer, the front end of the recording medium is detected by a paper front detecting sensor 18. The control circuit 40 controls, based on outputs of the paper front detecting sensor 18 and stored programs, the main motor 30, power supply circuit 21, switches 24 and 27, and current/voltage generating circuit 28, respectively.

Figure 8:
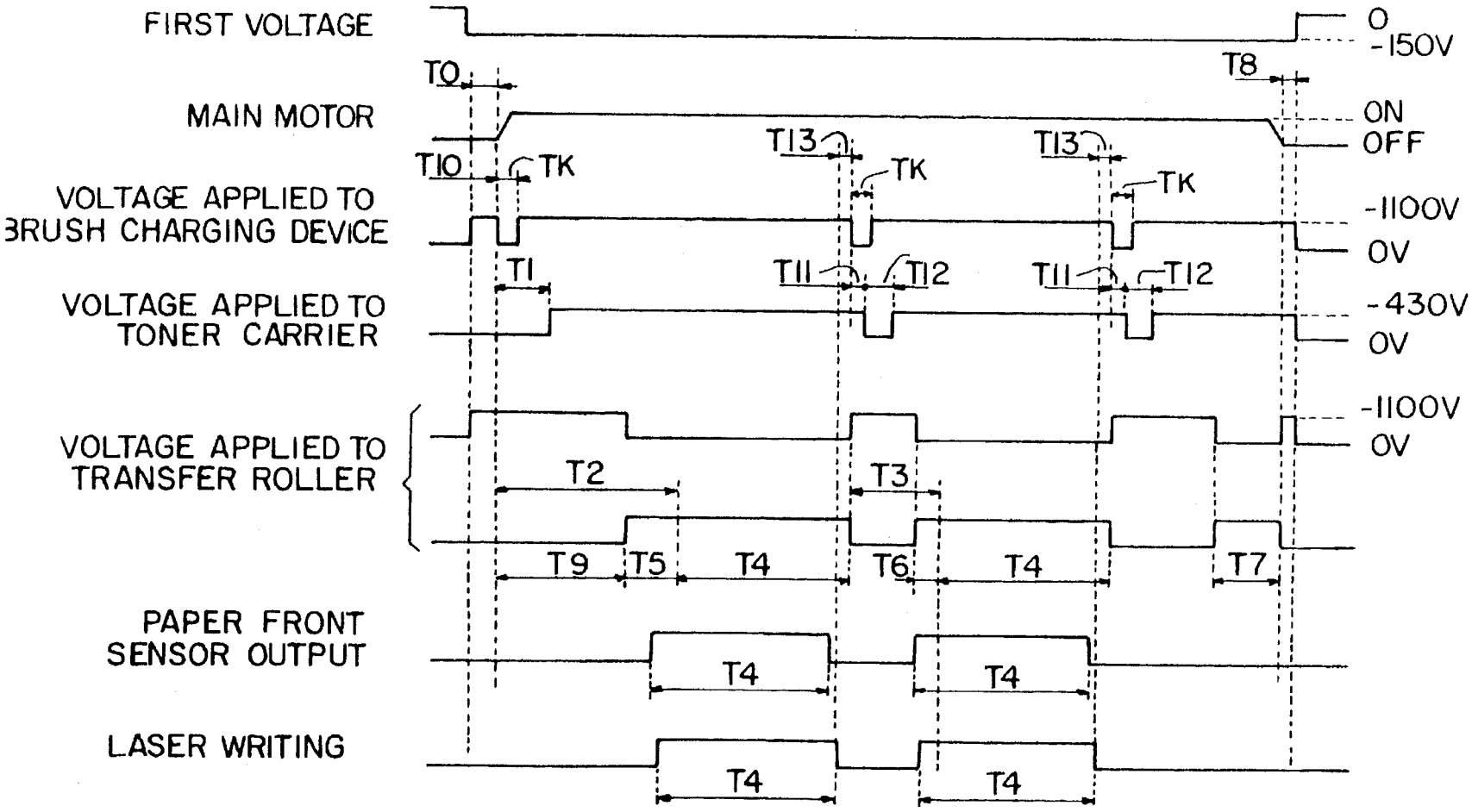
FIG. 8 is a timing chart which shows the overall operation of the first embodiment of the present invention.

Operation of the image forming apparatus of FIG. 7 will now be explained with reference to both FIG. 8 and FIG. 9. The symbols T0 through T13 appearing in FIG. 8 represent times defined in FIG. 9.

(1) Operation for Starting Charging

To begin with, a first voltage of −150 volts is supplied to the photoconductor drum 100 from the power supply circuit 21. The first voltage continues to be applied to the photoconductor drum 100 until the series of image forming processes shown in FIG. 8 are completed. Immediately after start of the supply of the first voltage, a charging voltage of −1,100 volts is applied to the brush charging device 1 from the power supply circuit 22 to charge the surface of the photoconductor drum 100. At T0 (msec) after the start of the charging, the main motor 30 is actuated to rotate the photoconductor drum 100.

The photoconductor drum 100, rotated only after a lapse of the warm-up time T0 (msec) for charging, is highly charged to −850 volts.

(2) First Removal of Toner Fragments and Shavings

After T0 (msec) has elapsed, the switch 24 is turned off to break the connection to the brush charging device 1 and the photoconductor drum 100 is connected to the grounding line 23, and thus the charging voltage of the brush charging voltage is switched to a second voltage of 0 volts during a TK (ms) period. Here, the potential of the photoconductor drum 100 is around −600 volts, a sum of the balance of the immediately preceding charging voltage and the first voltage of −150 volts in the first half of the TK (msec) period, as shown in FIG. 10, but −150 volts in the latter half (FIG. 11). The toner fragments and shavings adhering to the brush charging device 1 are attracted to the photoconductor drum 100 due to the potential difference between the brush charging device 1 and the photoconductor drum surface. More specifically, since the potential of the photoconductor drum 100 is more negative than the brush charging device 1 by at least −150 volts during the TK (msec) period, the positively polarized toner fragments and shavings are removed from the brush charging device 1 to the photoconductor drum 100. Provided that the second voltage is identical to the first voltage in polarity and has a lower absolute value than the first voltage, removal of the toner fragments and shavings continues. After a lapse of TK (msec), the switch 24 is again switched to restart charging of −1,100 volts.

Notably, the region on the photoconductor drum 10 which has received the applied 0 volts suffers a decrease in charge and attracts toner from the toner carrier 4 more readily. In order to overcome this tendency, the toner carrier 4 at the developing device 3 is grounded via a line 26 shown in FIG. 7 until completion of passage of the reduced-charge region (for T1 (msec)). Concretely, a third voltage of 0 volts is applied to the toner carrier 4 during T1 (msec). The toner carrier 4 at 0 volts is now positive relative to the surface (−150 volts) of the photoconductor drum 100. Accordingly, the negatively charged toner remains attached to the toner carrier 4, without being attracted to the photoconductor drum 100.

The third voltage to be applied to the toner carrier 4 need not be 0 volts; the only requirement is that the third voltage must have the same polarity as the first voltage and a lower absolute value than the first voltage. This is because the toner carrier 4 in this case becomes positively charged relative to the surface (having the first voltage) of the photoconductor drum 100. With this relationship, the power supply circuit 25 for generating a developing bias voltage is all that is needed as power supply equipment at the developing device, and thus no power supply circuit with the opposite polarity is required as according to the prior art.

(3) Operation during Non-imaging Periods

As illustrated in FIG. 8, the second-voltage (0 volts) applying period for the brush charging device 1 and the third-voltage (0 volts) applying period for the toner carrier 4 are present in two types of non-imaging periods; one is the period just after the main motor 30 is actuated, and the other type is an inter-non-imaging period. Accordingly, the positively polarized toner fragments and shavings are removed during these non-imaging periods. During the non-imaging periods, no electrostatic latent image is formed on the photoconductor drum 100, and thus neither developing nor transferring is performed, but supplying of the power supply 21 of the first voltage and driving of the main motor 30 is still active.

Also shown in FIG. 7 and FIG. 8, the toner carrier maintains the connection with the grounding line 26 until completion of passage of the reduced-charge region (for T1 and T12 (msec)), during which periods the third voltage of 0 volts is supplied to the toner carrier 4. For T1 and T12 (msec), the toner carrier 4 at 0 volts is positive relative to the surface (−150 volts) of the photoconductor drum 100. The result is that the toner having negative charge characteristics remains attached to the toner carrier 4 and is never attracted to the photoconductor drum 100, thus preventing production of black streaks. Here, T11 (msec) is equal to the time required for the reduced-charge region to reach the toner carrier 4.

(4) Operation during Imaging Period

In FIG. 8, when the sufficiently charged surface of the photoconductor drum 100 comes into contact with the toner carrier 4 (after a lapse of T1 (msec)), the control circuit 40 shown in FIG. 7 controls the switch 27 to establish a connection with a power supply circuit 25. Upon establishing the connection, a developing bias voltage of −430 volts is applied to the toner carrier 4 and the toner is negatively charged. Thereafter, writing is performed by laser light at the exposure device to form an electrostatic latent image on the surface of the photoconductor drum 100. In the case shown in FIG. 8, the writing time by laser light is T4 (msec). The laser light-irradiated and thus reduced-charge region shifts to positive polarity and attracts the negatively charged toner from the toner carrier 4 to form a toner image. The toner image is transferred to recording paper by the transfer roller 13. In the process of the transfer, a positive constant current of 3.5 μA is supplied to the transfer roller 13 from a current/voltage generating circuit 28, and the negatively charged toner is attracted to the recording paper. The transfer operation continues for a total period of T4 and T5 (msec). Upon the receipt of the voltage of −1,100 volts before formation of an electrostatic latent image and during the non-imaging period, the transfer roller 13 stops transferring. When the backend of the recording paper is detected by the sensor 18 and writing by the laser light is finished, the supply of a positive current to the transfer roller 13 terminates after a given period of time, and the aforementioned non-imaging period starts. Formation of an image on the next recording paper starts after completion of this non-imaging period.

As mentioned above, the above embodiment of the present invention has the following characteristic aspects:

1. The photoconductor drum 100 is biased at all times by a first voltage of −150 volts.

2. During the non-imaging period which includes the period just after the start of charging of the photoconductor drum 100, the positively charged toner fragments and shavings which have adhered to the brush charging device 1 are removed. In this case, a second voltage with the same polarity as the first voltage and with a lower absolute value than the first voltage is supplied to the brush charging device 1.

3. During the next non-imaging period, a third voltage which has the same polarity as the first voltage and a lower absolute value than the first voltage is supplied to the toner carrier 4, and the toner carrier 4 becomes positively charged relative to the surface (−150 volts) of the photoconductor drum 100. This relationship allows the negatively charged toner to remain adhered to the toner carrier 4, without being attracted to the photoconductor drum 100.

For the above characteristic aspects 1 and 2, the photoconductor drum 100 is kept negative relative to the brush charging device 1, and thus, different from the case of the prior art, no potential difference-free region is formed. Therefore, complete removal of positively charged toner fragments and shavings is accomplished. Further, for the characteristic aspect 3, the developing device does not need two types of power supplies which generate oppositely polarized voltages, and the power supply circuitry may be downsized accordingly.

Figure 12:
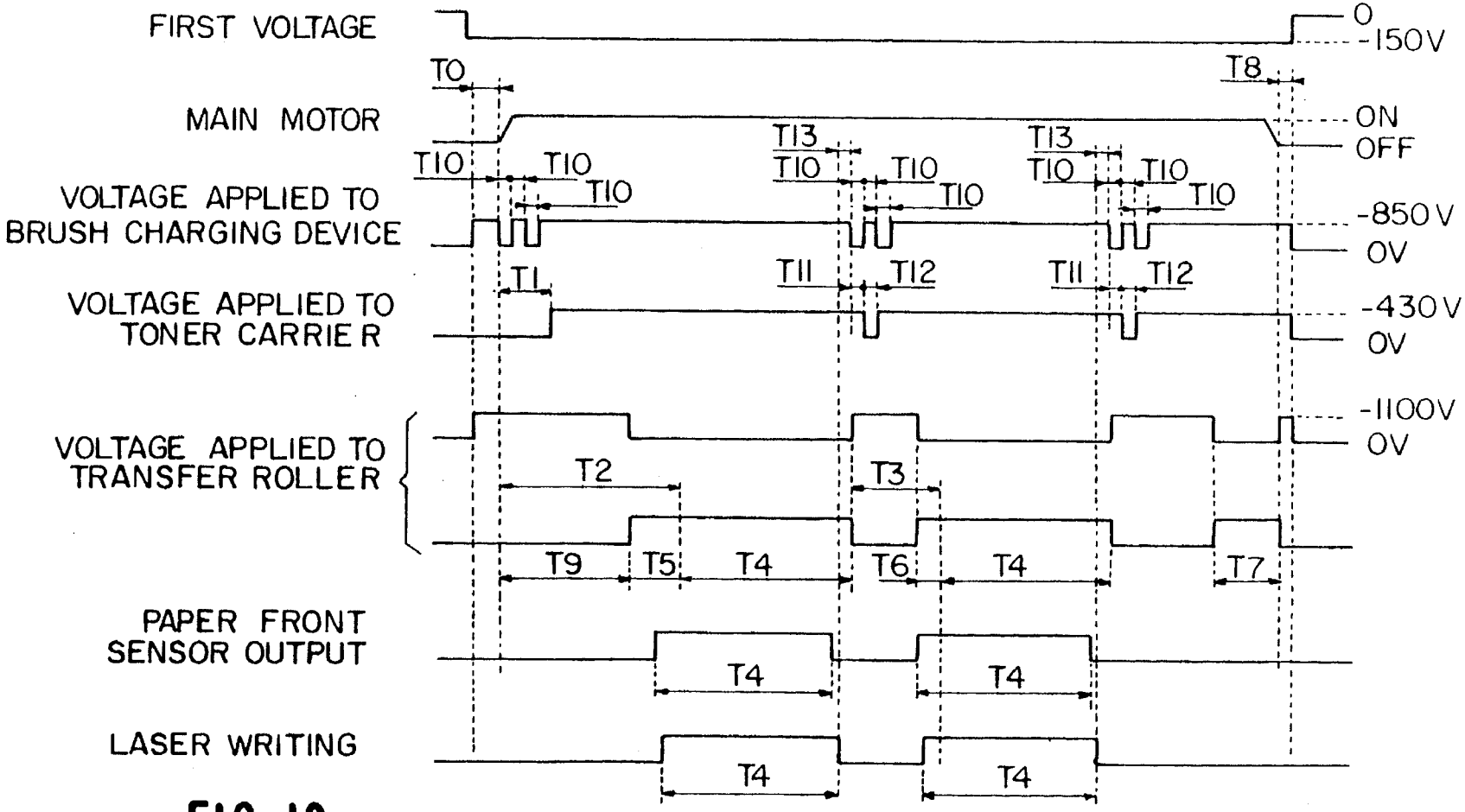
FIG. 12 is a timing chart for the overall operation of a second embodiment of the present invention.

FIG. 12 is a timing chart which shows the operation of the image forming apparatus according to another embodiment of the present invention. The difference of the embodiment shown in FIG. 12 from that of FIG. 8 is only in the manner of applying the voltage to the brush charging device 1 during non-imaging periods. According to the embodiment shown in FIG. 12, the switch 24 of FIG. 7 is switched to the grounding line 23, power supply circuit 22 and grounding line 23 again in that order at every T10 (msec). This operation will be elucidated with reference to FIG. 13 through FIG. 17. In the FIGS. 13 to 17, area A is a poorly charged area, area F is a sufficiently charged area and area B is an area having a potential of −150 (V). The switch 24 in FIG. 7 is in the OFF position for grounding and in the ON position for connection with the power supply circuit 22.

In FIG. 13, before the switch 24 is first turned OFF, the shavings of the conductor and toner fragments (block circles in the drawing) charged opposite to the photoconductor drum 100, that is, positively, are attracted to the brush charging device 1. For the first T10 (msec) starting with this state, the switch 24 remains in the OFF position, during which time the brush charging device 1 is grounded, as shown in FIG. 14. With this design about half the shavings and toner fragments are attracted to the surface of the photoconductor drum 100. While the switch 24 is OFF, the surface potential of the photoconductor drum drops to a poorly charged state. However, as shown in FIG. 15, since the switch 24 is ON during the next T10 (msec) period, the surface potential of the photoconductor drum 100 increases. Thereafter, as shown in FIG. 16, the switch 24 is again in the OFF position for T10 (msec), during which time the balance of the shavings and toner fragments is removed to the photoconductor drum 100. After the lapse of T10 (msec) the switch 24 is again ON as shown in FIG. 17, and the charging restarts. The T10 (msec) represents the time required for rotation of the photoconductor drum 100 by a distance half the width of the brush of the brush charging device 1, and is, for example, 91 (msec).

As mentioned above, the second embodiment allows removal of toner fragments and shavings by suppressing dropping in the surface potential of the photoconductor drum 100.

The present invention is not restricted to the above two embodiments. For example, the electrostatic latent image carrier, which is a photoconductor drum in the above embodiments, may be an endless belt with a photoconductive film coating on its surface. In addition, the toner carrier at the developing device may be of any other shape, without being limited to the shape of a roller. Furthermore, the charging device may be any type of contact charging device, including a roller charging device, without being limited to a brush charging device.

As explained above, since the second voltage, which is supplied to the charging device for the non-imaging period according to the present invention, has at all times the same polarity as and a lower absolute value than the first voltage applied, the toner fragments and shavings which have adhered to the charging device are attracted to the electrostatic latent image carrier by the potential difference between the charging device and the electrostatic latent image carrier. Accordingly, the fine powder with polarity opposite to that of the electrostatic latent image are entirely removed from the charging device.

Also, although a reduced-charge region is produced by applying the second voltage to the charging device during the process of removal, the toner carrier receives the applied third voltage which has the same polarity as and a lower absolute value than the first voltage. Accordingly, toner does not adhere to the reduced-charge region, and not only are no unwanted black streaks produced, but the power supply at the developing station has the same polarity as the charged polarity of the toner. As a result, the size of the power supply circuitry may be made more compact.

What is claimed is:

1. An image forming apparatus wherein an electrostatic latent image is formed on an electrostatic latent image carrier which is charged by a contact charging device, and a region including said formed electrostatic latent image is developed by toners supplied from a toner carrier, comprising:

first means for providing said electrostatic latent image carrier with a first voltage which has the same polarity as the charge characteristics of said electrostatic latent image carrier and said toners, said first voltage having a lower absolute value than a charging voltage for charging said electrostatic latent image carrier;

second means for providing said charging device with a second voltage which has the same polarity as said charge characteristics and has a lower absolute value than said first voltage, during a non-imaging period during which neither formation nor development of said electrostatic latent image is performed; and third means for providing said toner carrier with a third voltage which has the same polarity as said charge characteristics and has a lower absolute value than said first voltage, during said non-imaging period.

2. An image forming apparatus as claimed in claim 1, wherein said third means provides said toner carrier with said third voltage while the region of said electrostatic latent image carrier which has been charged by said second voltage is in contact with said toner carrier.

3. An image forming apparatus as claimed in claim 2, wherein said second means performs alternate switching between said charging voltage and said second voltage during said non-imaging period, for supply to said charging device.

4. An image forming apparatus as claimed in claim 2, wherein said first voltage is a voltage with an absolute value within a range of 50–200 volts.

5. An image forming apparatus as claimed in claim 1, wherein said second and third voltages are 0 volts.

6. An image forming apparatus wherein an electrostatic latent image is formed on an electrostatic latent image carrier which is charged by a contact charging device, and a region including said formed electrostatic latent image is developed by toners supplied from a toner carrier, comprising:

means for providing said electrostatic latent image carrier with a first voltage which has the same polarity as the charge characteristics of said electrostatic latent image carrier and said toners, said first voltage having a lower absolute value than a charging voltage for charging said electrostatic latent image carrier;

means for generating a second voltage which has the same polarity as said charge characteristics and has a lower absolute value than said first voltage;

first selection means for selecting one of said charging and second voltages for said charging device;

means for generating a developing bias voltage for developing with said toner carrier;

means for providing said toner carrier with a third voltage which has the same polarity as said charge characteristics and has a lower absolute value than said first voltage; and second selection means for selecting one of said developing bias and third voltages for said toner carrier, wherein said first selection means and said second selection means select said second and third voltages, respectively, during a non-imaging period during which neither formation nor development of said electrostatic latent image is performed.

7. An image forming apparatus as claimed in claim 6, wherein said second selection means selects said third voltage while the region of said electrostatic latent image carrier which has been charged by said second voltage is in contact with said toner carrier.

8. An image forming apparatus as claimed in claim 7, wherein said first selection means performs an alternate switching between said charging voltage and said second voltage during said non-imaging period, for supply to said charging device.

9. An image forming apparatus as claimed in claim 6, wherein said developing bias voltage has the same polarity as said charge characteristics and has a lower absolute value than said first voltage.

10. An image forming apparatus as claimed in claim 6, wherein said second and third voltages are 0 volts.

11. An image forming apparatus wherein an electrostatic latent image is formed on an electrostatic latent image carrier which is charged by a contact charging device, and a region including said formed electrostatic latent image is developed by toners supplied from a toner carrier, comprising:

first means for providing said electrostatic latent image carrier with a first voltage which has the same polarity as the charge characteristics of said electrostatic latent image carrier and said toners, said first voltage having a lower absolute value than a charging voltage for charging said electrostatic latent image carrier;

second means for providing said contact charging device with a second voltage, said second voltage being different from said first voltage such that toner fragments or shavings having an opposite polarity to the charging characteristics are transferred from said charging device to said electrostatic latent image carrier; and third means for providing said toner carrier with a third voltage during said non-imaging period so that said toners are not transferred from said toner carrier to said electrostatic latent image carrier.

12. An image forming apparatus wherein an electrostatic latent image is formed on an electrostatic latent image carrier which is charged by a contact charging device comprising:

first means for providing said electrostatic latent image carrier with a first voltage which has the same polarity as a surface potential of said electrostatic latent image carrier being charged by said contact charging device, said first voltage having a lower absolute value than a charging voltage for charging said electrostatic latent image carrier; and second means for providing said contact charging device with a second voltage, said second voltage being different from said first voltage such that a potential difference between said electrostatic latent image carrier and said contact charging device causes toner fragments and shavings to move from said charging device to said electrostatic latent image carrier.

13. The image forming apparatus of claim 12, further comprising:

third means for providing said toner carrier with a third voltage during said non-imaging period such that a potential difference between said toner carrier and said electrostatic latent image carrier causes said toners to remain in said toner carrier.

* * * * *